US008426759B2

(12) United States Patent
Nagatake et al.

(10) Patent No.: US 8,426,759 B2
(45) Date of Patent: Apr. 23, 2013

(54) VACUUM CIRCUIT BREAKER

(75) Inventors: Kazuhiro Nagatake, Numazu (JP); Tooru Kobayashi, Mishima (JP); Yoshihiko Matsui, Numazu (JP)

(73) Assignee: Meiden T&D Corporation, Tokyo (JP)

( * ) Notice: Subject to any disclaimer, the term of this patent is extended or adjusted under 35 U.S.C. 154(b) by 299 days.

(21) Appl. No.: 12/989,250

(22) PCT Filed: Apr. 21, 2009

(86) PCT No.: PCT/JP2009/058237

§ 371 (c)(1),
(2), (4) Date: Oct. 22, 2010

(87) PCT Pub. No.: WO2009/131238

PCT Pub. Date: Oct. 29, 2009

(65) Prior Publication Data

US 2011/0036812 A1 Feb. 17, 2011

(30) Foreign Application Priority Data

Apr. 24, 2008 (JP) ..... 2008-113396

(51) Int. Cl.
*H01H 33/666* (2006.01)

(52) U.S. Cl.
USPC ..... 218/140; 218/120; 218/7

(58) Field of Classification Search ..... 218/7, 14, 218/120, 118, 140, 154
See application file for complete search history.

(56) References Cited

U.S. PATENT DOCUMENTS

| | | | | |
|---|---|---|---|---|
| 5,239,150 | A * | 8/1993 | Bolongeat-Mobleu et al. | 218/84 |
| 6,020,567 | A * | 2/2000 | Ishikawa et al. | 218/154 |
| 2009/0095716 | A1 * | 4/2009 | Einschenk | 218/10 |

FOREIGN PATENT DOCUMENTS

| | | |
|---|---|---|
| CN | 2343664 | 10/1999 |
| JP | 59175529 | 10/1984 |
| JP | 06-103863 | 4/1994 |
| JP | 08-298040 | 11/1996 |
| JP | 2004-342359 | 12/2004 |
| JP | 2004342359 | 12/2004 |
| JP | 2005-038630 | 2/2005 |
| JP | 200538630 | 2/2005 |

OTHER PUBLICATIONS

Japanese Office Action mailed Apr. 10, 2012 in corresponding Japanese Patent Application No. 2008-113396 with English language translation.
Japanese Office Action mailed Nov. 13, 2012 in corresponding Japanese Patent Application No. 2008-113396 with English language translation.
Chinese Office Action dispatched Nov. 5, 2012 in corresponding Chinese Patent Application No. 200980113986.0 with English language translation.

* cited by examiner

*Primary Examiner* — Amy Cohen Johnson
*Assistant Examiner* — Marina Fishman
(74) *Attorney, Agent, or Firm* — Brundidge & Stanger, P.C.

(57) ABSTRACT

Vacuum circuit breakers are to gain an extended lifetime by reducing contact face damage of moving and fixed electrodes with improved voltage withstand performance therebetween and enhanced interruption performance. Vacuum circuit breaker of the present invention has bulb 10 having: insulative vacuum tube 11; and fixed electrode 12 on end of current-carrying conductor 13 and moving electrode 15 on end of another current-carrying conductor 16 arranged in insulative vacuum tube 11 with their electrode contact faces opposed each other. Operation system for manipulating current-carrying conductor 16 of moving electrode 15 is equipped with compression-spring 20 and auxiliary compression-spring 21 that increases initial opening speed of moving electrode 15. Auxiliary compression-spring 21 ceases energizing in the middle of a circuit breaking movement of moving electrode 15 and begins storing spring energy in the middle of a circuit closing movement of the same.

3 Claims, 4 Drawing Sheets

VACUUM CIRCUIT BREAKER

TECHNICAL FIELD

The present invention relates to a vacuum circuit breaker, more particularly relates to such a vacuum circuit breaker as has a compression-spring to apply a contact pressure to a set a moving contact and a fixed contact.

BACKGROUND ART

In general, a vacuum circuit breaker is widely used in electrical equipment in substations or in distribution systems on account of its capability in interrupting a large current with a small sized structure. The construction of a main body of bulb in a vacuum circuit breaker is such that a set of a fixed electrode fixed at the end of face of a current-carrying conductor and a moving electrode fixed similarly on the end face of another current-carrying conductor disposed facing each other is accommodated in an insulative vacuum tube of ceramic or similar material kept vacuum. The main body of bulb is used in a vacuum circuit breaker, being installed in an atmospheric environment or in an insulating gas atmosphere, wherein an operating device is provided near the main body of bulb to manipulate the moving electrode.

The operating device used in a vacuum circuit breaker causes the open-close motion between the moving electrode and the fixed electrode, wherein the operating device converts turning movement of a rotating shaft into a linear motion through a mechanism provided therein such as a lever to make the moving electrode move linearly. That is in particular; the operating device opens the moving electrode separating it from the fixed electrode on receipt of an open command from a control unit to interrupt current and closes these electrodes on receipt of a close or a reset command from the control unit; the operating device further provides a spring such as a compression-spring or a wipe spring for such motion.

The compression-spring or a device for similar purpose is used: to ensure a smooth operation of the moving electrode for opening and closing, to apply a predetermined magnitude of contact pressure over the moving and the fixed electrodes on completion of the closing operation, and to prevent a bouncing in the closing motion of the moving electrode to the fixed electrode that may damage the contact faces of the electrodes.

JP08-298040A1 (Patent Literature 3) has proposed an example of vacuum circuit breaker that uses a compression-spring or the like such as a pressing-spring. This vacuum circuit breaker has such a operating device that a lever, which operates a current-carrying conductor of a moving electrode, is fixed on a rotating shaft thereof and that the rotating shaft has a cam device at its top end. In this mechanism, a pressing-spring is arranged on the extended line of the current-carrying conductor of the moving electrode, wherein one end of the pressing-spring engages with the cam device. Thereby; while the lever moves from the electrodes-open position to the electrodes-close position, the cam device compresses the pressing-spring to store pressing energy for applying pressure; while in contrast the lever moves from the electrodes-close position to the electrodes-open position, the cam device allow the pressing-spring to release the stored pressing energy gradually.

Another example of vacuum circuit breaker that JP06-103863A1 (Patent Literature 2) has disclosed such a configuration that a motion converting mechanism is connected to the rotating shaft of a operating device through a lever so that this conversion mechanism will convert a horizontally reciprocating motion into a vertically reciprocating motion to operate a current-carrying conductor to which a moving electrode is fixed. At the bottom end of an insulative manipulating rod arranged on the extended line of the current-carrying conductor of the moving electrode, a wipe spring is installed to mediate a smooth operation of the close-open movements of the moving and fixed electrodes.

It is a common feature to the circuit breakers described in Patent Literatures 1 and 2 that each of them has single pressing-spring in its lever- or operating-mechanism. An intention of gaining a smooth close-open operation in the moving electrode relying on a single pressing-spring operating device encounters a ceiling.

Employing the single pressing-spring style involves a difficulty in the adjusting of the pressing force to a proper contact pressure on a set of moving and fixed electrodes; inadequate spring pressure of the pressing-spring does not give a proper assisting force to the operation of the operating device. FIG. 5 indicates a stroke characteristic of moving electrodes in terms of time, wherein T represents the time-elapse for movement of the moving electrode and St the traveling stroke of the electrode. As shown in the figure, the time-stroke characteristic of a moving electrode in a conventional vacuum circuit breaker behaves as given a time-stroke characteristic curve of S1.

That is: the moving electrode in a conventional vacuum circuit breaker moves linearly at a constant rate of move both in the opening-stage and the closing-stage, wherein the opening-stage is a period from the time point $T_o$ (shown on the left side in the diagram), at which the opening motion starts, to the time point $T_{o1}$ at which the opening motion ends, and the closing-stage is a period from the time point $T_e$ (shown on the right side in the diagram), at which the closing motion starts, to the time point $T_{e1}$ at which the closing movement ends.

This time-stroke characteristic prevents an improved interruption characteristic since operating the moving electrode through a operating device working on a single pressing-spring cannot produce a higher initial opening speed. Further, the single spring mechanism cannot produce a reduced closing speed of the moving electrode, which causes the impact energy E ($=kmv^2$), given by a constant k, the mass m, and the collision speed v of the moving electrode, to become large. Such larger energy easily causes bouncing between the contact faces of the moving and the fixed electrodes developing into such a problem as invites a serious contact face damage.

Consideration of such problem desires vacuum circuit breakers should gain an extended service lifetime by the use of such a compression-spring as will improve interruption performance reducing contact face damage of a moving and a fixed electrodes to which bouncing is responsible with improved voltage withstand performance between electrodes and enhanced interruption performance.

An advantage of the present invention is to provide a vacuum circuit breaker that offers an extended service lifetime rendered by an increased initial opening speed of a moving electrode with an improved interruption performance, a reduced contact face damage on a moving and a fixed electrodes, and an improved voltage withstand performance between electrodes and enhanced interruption performance.

DISCLOSURE OF INVENTION

The vacuum circuit breaker according to the present invention has a bulb, the bulb having an insulative vacuum tube; a fixed electrode fixed at the end of a current-carrying conductor and a moving electrode fixed at the end of another current-carrying conductor, the both electrodes being arranged in the insulative vacuum tube with contact faces of thoseof being opposed each other; and an operation system for the current-carrying conductor of the moving electrode equipped with a compression-spring, in which the operation system is equipped with an auxiliary compression-spring in such an arrangement that the auxiliary compression-spring ceases energizing in the middle of a circuit breaking movement of the moving electrode, and begins storing spring energy in the middle of a circuit closing movement of the moving electrode.

It is preferable that an intermediate connecting rod forming a part of the operation system should be engaged with the current-carrying conductor of the moving electrode, and that the compression-spring and the auxiliary compression-spring should be coaxially arranged with the current-carrying conductor at the engaging portion where the current-carrying conductor of the moving electrode engages with the intermediate connecting rod.

It further is preferable that the auxiliary compression-spring should have a larger spring constant than that of the compression-spring.

Effect of Invention

Such a configuration of the compression-spring and the auxiliary compression-spring as is defined in the present invention permits the manufacturing of a vacuum circuit breaker to be economical. Because, in the opening operation to open the moving electrode, the auxiliary compression-spring still continues to expand even after the moving electrode was separated from the fixed electrode, the initial breaking speed of the moving electrode can be increased with an improved interruption performance. Therefore, no large-sized operating device is demanded and accordingly manufacturing is economized. In the closing operation for the moving electrode, the auxiliary compression-spring reduces the closing speed of the moving electrode to a proper extent. This avoids the bouncing between the moving and the fixed electrodes and largely reduces damages on the electrodes with an improved voltage withstand performance between electrodes and the interruption performance, attaining an extended service life of a vacuum circuit breaker.

BEST MODE FOR CARRYING OUT THE INVENTION

The vacuum circuit breaker according to the present invention has a bulb, the bulb having: an insulative vacuum tube; a fixed electrode fixed at the end of a current-carrying conductor and a moving electrode fixed at the end of another current-carrying conductor, the both electrodes being arranged in the insulative vacuum tube with contact faces thoseof being opposed each other. The operation system for manipulating the current-carrying conductor of the moving electrode is equipped with a compression-spring, in which the operation system is further equipped with an auxiliary compression-spring in an arrangement that the auxiliary compression-spring ceases energizing in the middle of a circuit breaking movement of the moving electrode and begins storing spring energy in the middle of a circuit closing movement of the moving electrode.

[Embodiment 1]

Figure 1:
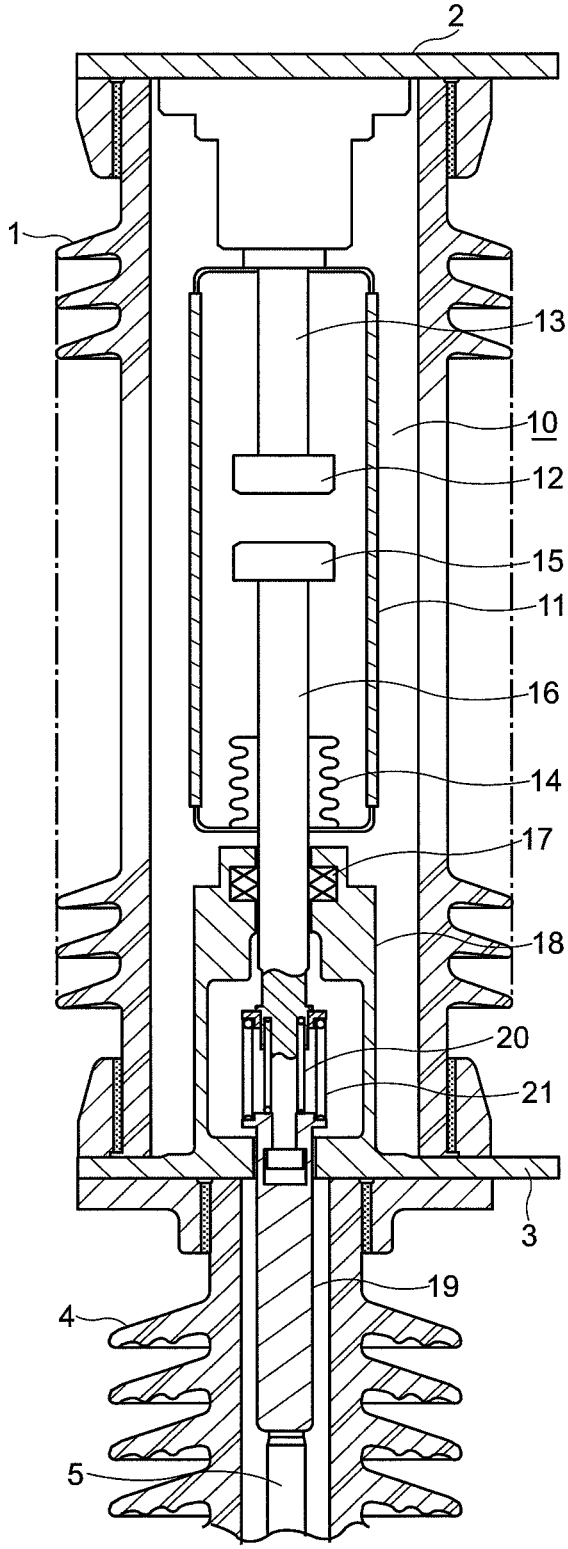
FIG. 1 is a schematic longitudinal sectional view to show a partial section of the live tank type vacuum circuit breaker, which is an embodiment of the present invention.

The following explains an example of embodiments of the vacuum circuit breaker by the present invention illustrated in figures. The example of the vacuum circuit breaker shown in FIG. 1 is an live tank type vacuum circuit breaker. This breaker has such a construction that a main body of bulb 10 is accommodated in a porcelain bushing 1, that terminals 2 and 3 are arranged on the top and the bottom faces of the porcelain bushing 1, and that the inside thereof is filled with insulating gas.

The porcelain bushing 1 is supported by a hollow supporting insulator 4 to assure an insulating separation. An insulative manipulation rod 5, which connects to a lever (not shown) or a similar device on a operating device through the supporting insulator 4, manipulates the main body of bulb 10 for open-close.

The main body of bulb 10, which is the major part of the vacuum circuit breaker, is made of an insulative vacuum tube 11 of ceramic and inside of which is kept vacuum, similarly to a conventional art. A fixed electrode 12 is fixed at the end of a current-carrying conductor 13 fastened at one end of the insulating container 11. A moving electrode 15 is fixed at the end of a current-carrying conductor 16 fastened to a bellows 14 installed other end of the insulative vacuum tube 11. The contact faces of the fixed electrode 12 and the moving electrode 15 are arranged, being opposed facing each other.

In the example shown in FIG. 1, the current-carrying conductor 16 of the moving electrode 15 is engaged with a corrector 17 retained by a connecting conductor 18. Thereby, an electrical circuitry: the terminal 2—the current-carrying conductor 13—the fixed electrode 12—the moving electrode 15—the current-carrying conductor 16—the corrector 17—the connecting conductor 18—the terminal 3, is established.

An intermediate connecting rod 19, which forms a part of the operation system, is arranged between the current-carrying conductor 16, which is arranged coaxially within the connecting conductor 18, and the insulative manipulation rod 5. At the joint between the current-carrying conductor 16 and the intermediate connecting rod 19, a compression-spring 20 and further an auxiliary compression-spring 21 are disposed, wherein the compression-spring 20 applies contact pressure between the fixed electrode 12 and the moving electrode 15 assisting the manipulation force applied by the operating device for opening the moving electrode 15. The auxiliary compression-spring 21 is disposed in order to give additional pressure over the pressure by the compression-spring 20 to increase initial opening speed.

Figure 2:
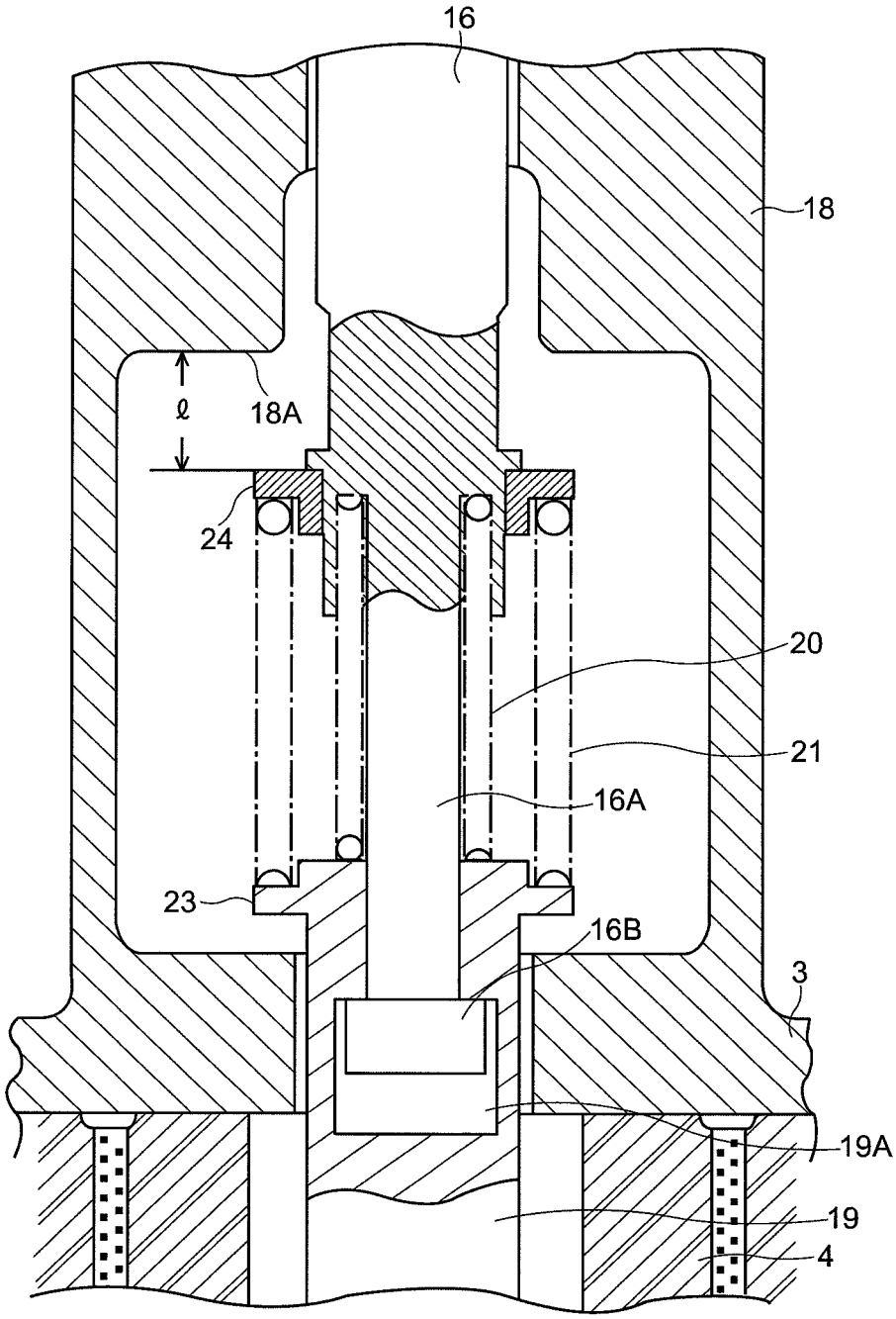
FIG. 2 is an enlarged schematic longitudinal sectional view to show the main part in FIG. 1.

More detailed explanation about the above-stated construction with FIG. 2 is as follows. A part of the bottom end of the current-carrying conductor 16 is shaped thin forming an engagement part 16A. The engagement part 16A engages in sliding fit with an engagement groove 19A formed at the end of the intermediate connecting rod 19, wherein an engaging protrusion 16B is provided to prevent disengaging.

The compression-spring 20, which applies contact pressure between the fixed electrode 12 and the moving electrode 15, and the auxiliary compression-spring 21 are arranged on the engagement part 16A coaxially. Because the auxiliary compression-spring 21 is to assist the working of the compression-spring 20, such a spring as is capable of applying pressure, at least in the same manner as the compression-spring 20, should be used as an auxiliary spring for a desired behavior of these arrangements. It is therefore preferable that the spring constant of the auxiliary compression-spring 21 should be larger than that of the compression-spring 20.

One end of the auxiliary compression-spring 21 shown in FIG. 2 rests on a spring seat 23 provided at the top end of the intermediate connecting rod 19; the other end of the same rests on a sliding spring seat 24 provided in slide fit manner at the bottom end of the current-carrying conductor 16.

This arrangement applies a large combined spring forces synergistically generated by the compression-spring 20 and the auxiliary compression-spring 21 to the opening action of the electrodes 12 and 15 at the initial stage of the opening motion with increased initial breaking speed. The auxiliary compression-spring 21 is released from a locking part 18A in the middle of the movement of the current-carrying conductor 16 (i.e., in the middle of the opening movement of electrodes) and then further moves by a stretch 1.

The distance between the locking part 18A of the connecting conductor 18 and the sliding spring seat 24, is determined considering the amount of deflection d of the auxiliary compression-spring 21 necessary for storing energy of spring pressure of the auxiliary compression-spring 21 and the electrode separation distance S (=l+d) of the moving electrode 15 in the opening motion.

In the reverse motions, the sliding spring seat 24 engages with the locking part 18A formed on a part of the connecting conductor 18 in the middle of the closing motion in the closing action of the electrodes 12 and 15 caused by the upward movement of the current-carrying conductor 16 led by operating the operating device, and then the auxiliary compression-spring 21 begins storing the energy of its spring pressure. As the current-carrying conductor 16 and the intermediate connecting rod 19 move, the auxiliary compression-spring 21 stores its spring pressure to a full extent to permit the auxiliary compression-spring 21 to apply pressure between the electrodes 12 and 15 jointly with the compression-spring 20 for an increased contact pressure on completion of the closing motion, and to permit use of the stored spring pressure in the next breaking motion.

Figure 3:
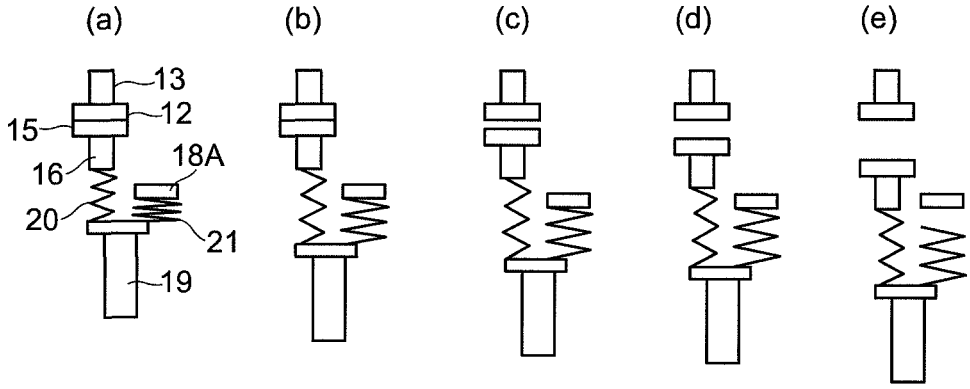
FIGS. 3(*a*) to 3(*e*) are a schematic diagrams to sequentially show the process of movement of the electrode in the opening motion in the vacuum circuit breaker by the present invention.
Figure 4:
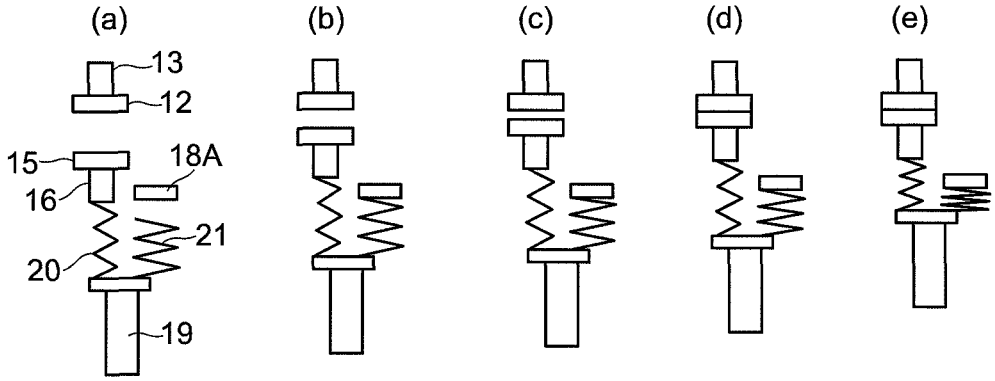
FIGS. 4(*a*) to 4(*e*) are schematic diagrams to sequentially show the process of the movement of the electrode in the closing motion in the vacuum circuit breaker by the present invention.

The following explains the process of the opening movement of the moving electrode 15 of the vacuum circuit breaker by the present invention referring to FIGS. 3(*a*) to 3(*e*), and the process of the closing movement of the same referring to FIGS. 4(*a*) to 4(*e*).

Immediately before the operating device starts to work according to the open command from a control unit, both the electrodes 12 and 15 are in the close state, and both the compression-spring 20 and the auxiliary compression-spring 21 arranged in the operating system are in the compressed state holding spring pressure.

At the beginning stage of the opening movement of the moving electrode 15 for interruption as shown in FIG. 3(*b*), the intermediate connecting rod 19 moves downward, but the fixed electrode 12 and the moving electrode 15 are still in the close state. As a consequence of this state, both the compression-spring 20 and the auxiliary compression-spring 21 expand simultaneously boosting the operating force of the operating system with increased initial opening speed.

When the moving electrode 15 opens, the compression-spring 20 and the auxiliary compression-spring 21 keep discharging their stored spring energy as shown in FIG. 3(*b*) causing the initial opening speed to continue being increased. As shown in FIG. 3(*c*), the force of the compression-spring 20 reaches discharged state when it expands to its maximum length, but the auxiliary compression-spring 21 continues discharging its stored spring energy until it expands to its maximum length; thereby, the initial opening speed is maintained.

After this state, as shown in FIG. 3(*d*), a cut-off spring (not shown) connected to such as a lever in the operating device continues to expand and the opening movement of the moving electrode 15 keeps going without working of the compression-spring 20 nor the auxiliary compression-spring 21. At the final stage, the moving electrode 15 fully moves to a complete open as shown in FIG. 3(*e*) with the opening motion completed.

Figure 5:
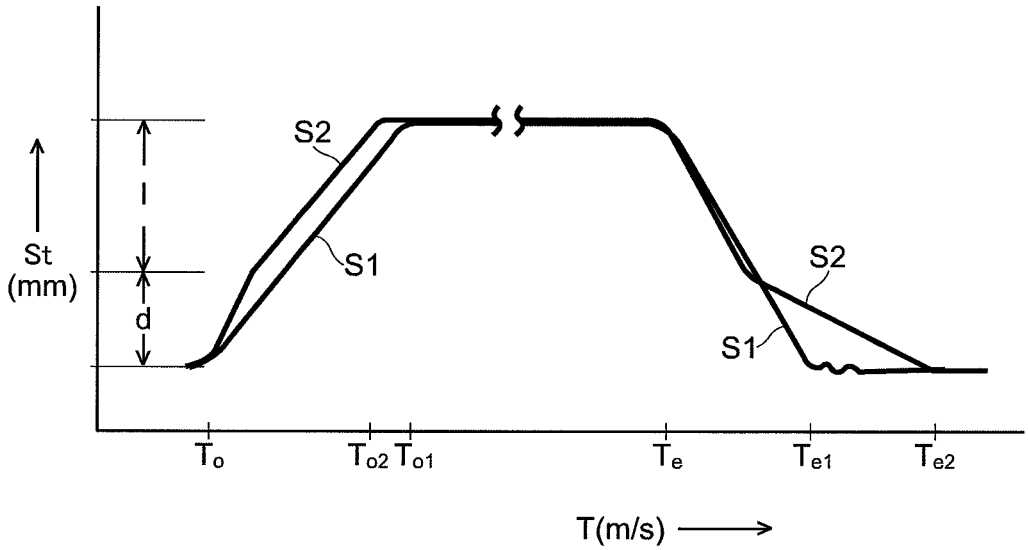
FIG. 5 is a diagram of the stroke characteristic of the moving electrode in vacuum circuit breakers.

The movement of the moving electrode 15 of the vacuum circuit breaker by the present invention in opening motion is as follows. As the diagram of the stroke characteristic S2 given in FIG. 5 shows, the compression-spring 20 and the auxiliary compression-spring 21 begin to add their pressure to the manipulating force of the operating system from the time point $T_o$ (shown on the left side in the diagram) at which the opening motion starts. This causes the initial opening speed of the moving electrode 15 to be increased. Consequently, the time length until the time point of $T_{o2}$, at which the opening movement completes, is shortened with enhanced opening performance.

When the operating device starts working on receipt of the open-close command from the control unit, the intermediate connecting rod 19 moves upward as shown in FIG. 4(*b*) from the state in which the moving electrode 15 is in the open state as shown in FIG. 4(*a*). Following this movement, the auxiliary compression-spring 21 contacts the locking part 18A. Thereby, the auxiliary compression-spring 21 is compressed by the movement of the intermediate connecting rod 19 to begin storing the spring energy in precedence.

When the intermediate connecting rod 19 moves upward as shown in FIG. 4(*d*), both the compression-spring 20 and the auxiliary compression-spring 21 become being compressed continuing to store spring energy until both the electrodes 12 and 15 complete the closing movement.

Thus, the end portion of the auxiliary compression-spring 21 engages with the locking part 18A as the current-carrying conductor 16 and the intermediate connecting rod 19 move, before the moving electrode 15 touches the fixed electrode 12. Thereafter, storing energy for manipulation starts taking a form of spring pressure in the auxiliary compression-spring 21 and continues until both the electrode 12 and 15 complete their closing movement. In the vacuum circuit breaker by the present invention, on account of these mechanism, the stroke characteristic of the moving electrode 15 does not behave linearly for the span of the electrode separation distance S (=l+d) but behaves in a changed manner for the latter half of the closing movement as shown in FIG. 5.

This means that the movement of the moving electrode 15 in terms of time is almost linear for the period from the time point $T_e$ (shown on the right side of the diagram), at which the closing movement starts, until the moving electrode 15 reaches the position apart by the stretch l acted on by the compression-spring 20. The electrode 15 however moves at a different rate from the time point when the auxiliary compression-spring 21 begins to deflect, and moves thereafter at the changed rate until the deflection reaches the amount d to complete the closing movement of which time point is represented as $T_{e2}$. Therefore, it is practicable to make the end of the closing movement delay and accordingly the closing speed of the moving electrode 15 can be slowed.

Consequently, the impact energy on the contact faces of electrodes 12 and 15 is largely reduced with the bouncing between the contact faces effectively prevented. For example, when the closing speed of the moving electrode 15 is reduced by 30 percent from a conventional value, the impact energy becomes half the conventional value, which is a useful bouncing prevention.

Above-stated embodiment has been explained taking an example of application of the present invention to an live tank type vacuum circuit breaker. It is however evident that the present invention is also applicable to a breaker that is used in an open air or being accommodated in a housing. In the live tank type vacuum circuit breaker in the embodiment, the compression-spring 20 and the auxiliary compression-spring 21 are arranged in a coaxial manner on the joint between the end portion of the current-carrying conductor 16 and the intermediate connecting rod 19. This location in the arrangement however may be modified depending on the situation. For example, the compression-spring 20 and the auxiliary compression-spring 21 may be installed on an insulative rod, or the insulative manipulating rod, connected to the current-carrying conductor 16 of the moving electrode 15 depending on the situation. Further, the locking part 18A can be provided at another suitable place with necessary constructional modification.

Industrial Applicability

The vacuum circuit breaker according to the present invention has an improved interruption performance rendered by increased initial opening speed of the moving electrode; there is no need for a larger-sized operating device, which permits an economical manufacturing the breaker. Thus, the invented vacuum circuit breaker is advantageously applicable to various types of vacuum circuit breakers in equipment for electric substations and distribution systems.

The invention claimed is:

1. A vacuum circuit breaker having a bulb, the bulb comprising:

an insulative vacuum tube;

a fixed electrode fixed at the end of a current-carrying conductor and a moving electrode fixed at the end of another current-carrying conductor, the both electrodes being arranged in the insulative vacuum tube with contact faces thoseof being opposed each other; and an operation system for the current-carrying conductor of the moving electrode equipped with a compression-spring, wherein the operation system is equipped with an auxiliary compression-spring in such an arrangement that the auxiliary compression-spring ceases energizing in the middle of a circuit breaking movement of the moving electrode, and begins storing spring energy before the moving electrode contacts the fixed electrode in a circuit closing movement of the moving electrode.

2. The vacuum circuit breaker according to claim 1, wherein an intermediate connecting rod forming a part of the operation system is engaged with the current-carrying conductor of the moving electrode, and the compression-spring and the auxiliary compression-spring are coaxially arranged with the current-carrying conductor at the engaging portion where the current-carrying conductor of the moving electrode engages with the intermediate connecting rod.

3. The vacuum circuit breaker according to claim 1, wherein the auxiliary compression-spring has a larger spring constant than that of the compression-spring.

* * * * *